US011499728B2

(12) United States Patent
Handa et al.

(10) Patent No.: US 11,499,728 B2
(45) Date of Patent: Nov. 15, 2022

(54) AIR PROCESSING DEVICE

(71) Applicant: DAIKIN INDUSTRIES, LTD., Osaka (JP)

(72) Inventors: Youichi Handa, Osaka (JP); Masaya Nishimura, Osaka (JP); Yoshiteru Nouchi, Osaka (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/640,299

(22) PCT Filed: Aug. 21, 2018

(86) PCT No.: PCT/JP2018/030750
§ 371 (c)(1),
(2) Date: Feb. 19, 2020

(87) PCT Pub. No.: WO2019/044576
PCT Pub. Date: Mar. 7, 2019

(65) Prior Publication Data

US 2020/0248918 A1 Aug. 6, 2020

(30) Foreign Application Priority Data

Aug. 28, 2017 (JP) ..... JP2017-163415

(51) Int. Cl.
*F24F 3/14* (2006.01)
*F24F 11/32* (2018.01)
(Continued)

(52) U.S. Cl.
CPC ..... *F24F 3/14* (2013.01); *F24F 11/32* (2018.01); *F24F 11/46* (2018.01); *F24F 11/48* (2018.01);
(Continued)

(58) Field of Classification Search
CPC .... F24F 3/14; F24F 11/46; F24F 11/89; F24F 11/32; F24F 11/63; F24F 11/48; F24F 13/222; F24F 2006/008
See application file for complete search history.

(56) References Cited

U.S. PATENT DOCUMENTS 7,537,050 B2 5/2009 Ikegami et al.
2006/0278084 A1* 12/2006 Kim ..... F24F 13/222 96/140
(Continued)

FOREIGN PATENT DOCUMENTS

CN 104481891 A 4/2015
CN 104596051 A 5/2015
(Continued)

OTHER PUBLICATIONS

International Preliminary Report on Patentability, dated Mar. 12, 2020, and Written Opinion of the International Searching Authority, for International Application No. PCT/JP2018/026234.
(Continued)

*Primary Examiner* — Nelson J Nieves
(74) *Attorney, Agent, or Firm* — Birch, Stewart, Kolasch & Birch, LLP

(57) ABSTRACT

The air processing device is provided with a processing unit that determines the state of a predetermined part(s) in a casing on the basis of the change in a plurality of image data acquired by an imaging unit.

13 Claims, 13 Drawing Sheets

(51) Int. Cl.

| | |
|---|---|
| ***F24F 11/63*** | (2018.01) |
| ***F24F 11/48*** | (2018.01) |
| ***F24F 13/22*** | (2006.01) |
| ***F24F 11/46*** | (2018.01) |
| ***F24F 11/89*** | (2018.01) |
| ***F24F 6/00*** | (2006.01) |

(52) U.S. Cl.
CPC ..... *F24F 11/63* (2018.01); *F24F 11/89* (2018.01); *F24F 13/222* (2013.01); *F24F 2006/008* (2013.01)

(56) References Cited

U.S. PATENT DOCUMENTS

| | | | | |
|---|---|---|---|---|
| 2009/0025711 | A1* | 1/2009 | Edwards | A01G 9/246 126/704 |
| 2009/0251324 | A1* | 10/2009 | Frederick | F25B 49/005 340/626 |
| 2014/0262134 | A1 | 8/2014 | Arensmeiier et al. | |
| 2015/0115482 | A1* | 4/2015 | Jang | G01F 23/24 261/24 |
| 2016/0056381 | A1* | 2/2016 | Wang | H01L 51/5259 257/40 |
| 2016/0153824 | A1* | 6/2016 | Myeong | G01F 23/72 73/306 |

FOREIGN PATENT DOCUMENTS

| | | | | |
|---|---|---|---|---|
| CN | 104822046 | A | | 8/2015 |
| CN | 103234261 | B | | 9/2015 |
| CN | 106288158 | A | | 1/2017 |
| EP | 3712534 | A1 | | 9/2020 |
| JP | 58-138938 | A | | 8/1983 |
| JP | 02236420 | A | * | 9/1990 |
| JP | H08-219528 | A | | 8/1996 |
| JP | 2000180247 | A | * | 6/2000 |
| JP | 2002-101321 | A | | 4/2002 |
| JP | 2005-292066 | A | | 10/2005 |
| JP | 2005292066 | A | * | 10/2005 |
| JP | 2006-64227 | A | | 3/2006 |
| JP | 2007-46864 | A | | 2/2007 |
| JP | 2007-255840 | A | | 10/2007 |
| JP | 2010-242994 | A | | 10/2010 |
| JP | 2012-32071 | A | | 2/2012 |
| JP | 2013-160449 | A | | 8/2013 |
| JP | 2016-196992 | A | | 11/2016 |
| KR | 2017099516 | A | * | 9/2017 |

OTHER PUBLICATIONS

International Preliminary Report on Patentability, dated Mar. 12, 2020, and Written Opinion of the International Searching Authority, for International Application No. PCT/JP2018/030750.
English Machine Translation of JP-2005-292066 A, published Oct. 20, 2005.
English Machine Translation of JP-2007-46864 A, published Feb. 22, 2007.
English Machine Translation of JP-2013-160449 A, published on Aug. 19, 2013.
English Machine Translation of JP-2016-196992 A, published on Nov. 24, 2016.
International Search Report, issued in PCT/JP2018/026234, PCT/ISA/210, dated Oct. 2, 2018.
International Search Report, issued in PCT/JP2018/030750, PCT/ISA/210, dated Nov. 20, 2018.
Written Opinion of the International Searching Authority, issued in PCT/JP2018/030750, PCT/ISA/237, dated Nov. 20, 2018.
Extended European Search Report dated Jul. 28, 2020 for Application No. 18850249.6.
Extended European Search Report dated Jul. 28, 2020 for Application No. 18851325.3.
Extended European Search Report for European Application No. 21193232.2, dated Nov. 11, 2021.
English Translation of Office Action dated Aug. 5, 2022 in counterpart Chinese Application No. 201880055458.3.

* cited by examiner

AIR PROCESSING DEVICE

TECHNICAL FIELD

The present disclosure relates to an air processing device.

BACKGROUND ART

An air processing device such as an air-conditioning device, a ventilation apparatus, a humidity control apparatus, and an air cleaner has been known in the art. In an air processing device of Patent Document 1, a camera is provided in a casing. The camera images a filter. Image data of the filter imaged by the camera is output to a centralized monitor via a LAN. The service provider or any other operator checks this image data, so that the state of the filter (clogging, breakage, and the like) can be determined.

CITATION LIST

Patent Documents

Patent Document 1: Japanese Unexamined Patent Publication No. 2007-46864

SUMMARY OF THE INVENTION

Technical Problem

The air-conditioning device disclosed in the Patent Document 1 determines clogging and the like of the filter on the basis of the state of one image data. Specifically, the proportion of pixels in a portion classified as a breakage of the filter among pixels of the entire filter in the image data is determined, and a breakage of the filter is determined on the basis of the proportion.

In such a determination method based on one image data, there is a possibility that the state of the target part is not determined accurately.

An object of the present disclosure is to improve determination accuracy of the state of a target part.

Solution to the Problem

The first aspect is directed to an air processing device including: a casing (20) in which air flows; an imaging unit (70) that acquires a plurality of image data of at least one predetermined object (45*a*, 60) to be imaged in the casing (20); and a processing unit (85) that determines the state of the at least one predetermined part (45, 66, 68) in the casing (20) on the basis of a change in the plurality of image data acquired by the imaging unit (70). The plurality of image data include still images contained in moving images.

The processing unit (85) of the first aspect determines the state of the predetermined part(s) (45, 66, 68) on the basis of the change in the plurality of image data of the object (45*a*, 60) to be imaged. That is, the processing unit (85) determines the state of the part (45, 66, 68) considering not one image data, but the state change in the plurality of image data.

The second aspect according to the first aspect is directed to an air processing device including a tray (60) for receiving water; and discharge portion (66, 68) for discharging water in the tray (60), wherein the imaging unit (70) acquires a plurality of image data of the tray (60) that is the at least one object to be imaged, and the processing unit (85) determines an abnormality of the discharge portion (66, 68) that are the at least one predetermined part (45, 66, 68) on the basis of a change in height of a water surface in the tray (60) in the plurality of image data.

The processing unit (85) of the second aspect determines an abnormality of the discharge portion (66, 68), which are predetermined parts, on the basis of the change in height of the water surface in the tray (60) in the plurality of image data.

The third aspect according to the second aspect is directed to an air processing device, wherein the discharge portion (66, 68) include a drain pump (66) for pumping water in the tray (60).

The processing unit (85) of the third aspect determines an abnormality of the drain pump (66), which is a predetermined part, on the basis of the change in height of the water surface in the tray (60) in the plurality of image data.

The fourth aspect according to the third aspect is directed to an air processing device, wherein the imaging unit (70) acquires image data of the plurality of image data of the tray (60) during a first time period from a first point in time before or at actuation of the drain pump (66) to a second point in time that is after the actuation of the drain pump (66), and the processing unit (85) determines an abnormality of the drain pump (66) on the basis of a change in height of the water surface in the plurality of image data acquired during the first time period.

The processing unit (85) of the fourth aspect determines an abnormality of the drain pump (66) on the basis of the change in height of the water surface in the tray (60) acquired during the first time period between the first point in time and the second point in time. The first point in time is before or at actuation of the drain pump (66). Thus, the height of the water surface in the tray (60) is relatively high at the first point in time. The second point in time is after the actuation of the drain pump (66). Thus, when the drain pump (66) operates normally, the height of the water surface in the tray (60) is lower at the second point in time than that at the first point in time. Accordingly, an abnormality of the drain pump (66) can be determined by considering the change in height of the water surface.

The fifth aspect according to the third or fourth aspect is directed to an air processing device, wherein the imaging unit (70) acquires the plurality of image data of the tray (60) during a predetermined second time period after actuation of the drain pump (66), and the processing unit (85) determines an abnormality of the drain pump (66) on the basis of a change in height of the water surface in the plurality of image data acquired during the second time period.

The processing unit (85) of the fifth aspect determines an abnormality of the drain pump (66) on the basis of the change in height of the water surface during the second time period after the actuation of the drain pump (66). When the drain pump (66) has an abnormality after the actuation of the drain pump (66), water in the tray (60) cannot be pumped normally, and the height of the water surface in the tray (60) may increase. This allows an abnormality of the drain pump (66) to be determined on the basis of the degree of increase in height of the water surface in the tray (60).

The sixth aspect according to any one of the first to fifth aspects is directed to an air processing device, wherein the processing unit (85) determines an abnormality of the discharge portion (66, 68) on the basis of an amount of change in or change rate of the height of the water surface in the plurality of image data.

The processing unit (85) of the sixth aspect determines an abnormality of the discharge portion (66, 68) on the basis of the amount of change in or change rate of the height of the water surface in the tray (60).

The seventh aspect according to the first aspect is directed to an air processing device further including: a humidifier (45) including at least one hygroscopic member (45*a*) to which water is supplied, wherein the imaging unit (70) acquires a plurality of image data of the at least one hygroscopic member (45*a*) that is the object to be imaged, and the processing unit (85) determines an abnormality of the humidifier (45) that is the at least one predetermined part (45, 66, 68) on the basis of a change in wet state of the at least one hygroscopic member (45*a*) in the plurality of image data.

The processing unit (85) of the seventh aspect determines an abnormality of the humidifier (45) on the basis of the change in wet state of the hygroscopic member(s) (45*a*) of the humidifier (45). When the humidifier (45) has an abnormality, water is not supplied to the hygroscopic member(s) (45*a*), so that the hygroscopic member(s) (45*a*) is gradually dried.

DESCRIPTION OF EMBODIMENTS

Embodiments of the present disclosure are described below with reference to the drawings. The embodiments below are merely exemplary ones in nature, and are not intended to limit the scope, applications, or use of the present invention.

First Embodiment

An air processing device according to the first embodiment is an air-conditioning device (10) that adjusts at least the temperature in the room. The air-conditioning device (10) adjusts the temperature of room air (RA), and supplies the temperature-adjusted air as supply air (SA) into the room. The air-conditioning device (10) includes an indoor unit (11) installed in a space in the ceiling cavity. The indoor unit (11) is connected to an outdoor unit (not shown) through refrigerant pipes. Thus, the air-conditioning device (10) forms a refrigerant circuit. The refrigerant circuit is filled with a refrigerant that circulates to perform a vapor compression refrigeration cycle. The outdoor unit is provided with a compressor and an outdoor heat exchanger that are connected to the refrigerant circuit, and an outdoor fan that corresponds to the outdoor heat exchanger.

<Indoor Unit>

Figure 1:
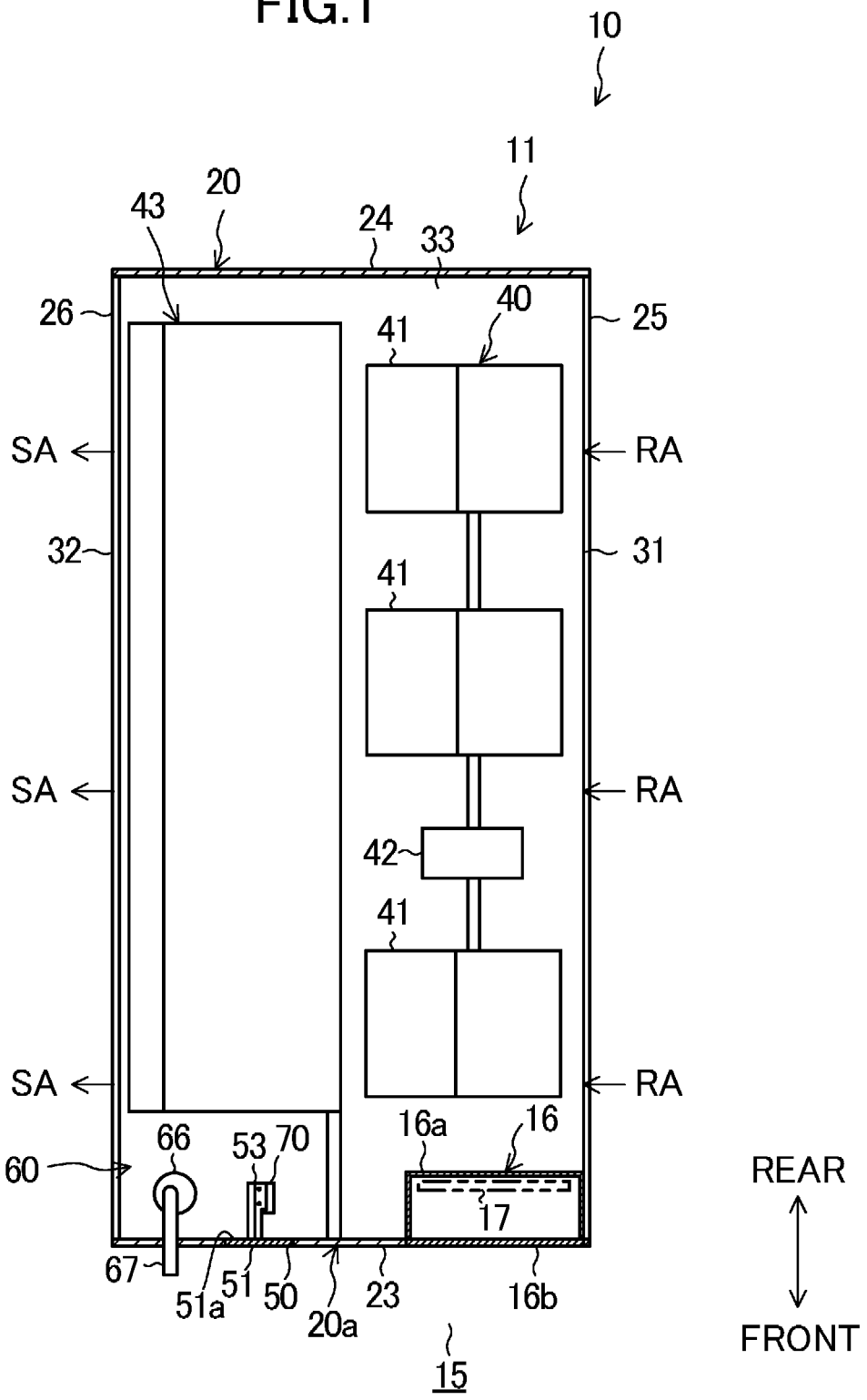
FIG. 1 is a plan view illustrating an internal structure of an air-conditioning device according to the first embodiment.
Figure 2:
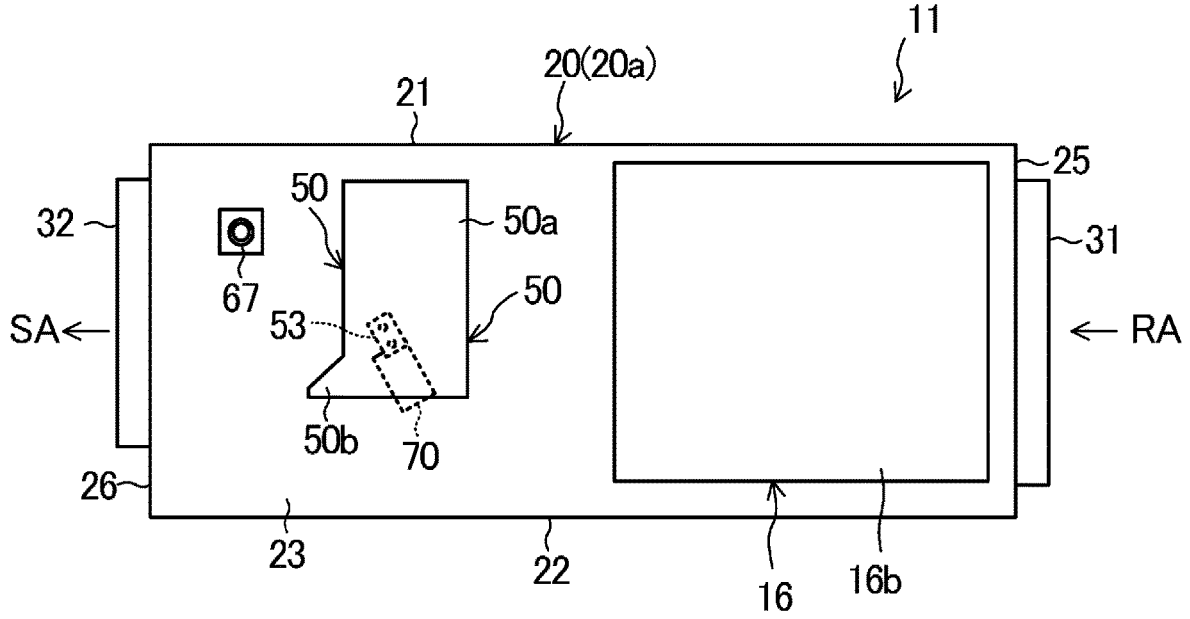
FIG. 2 is a front view illustrating the air-conditioning device according to the first embodiment.
Figure 3:
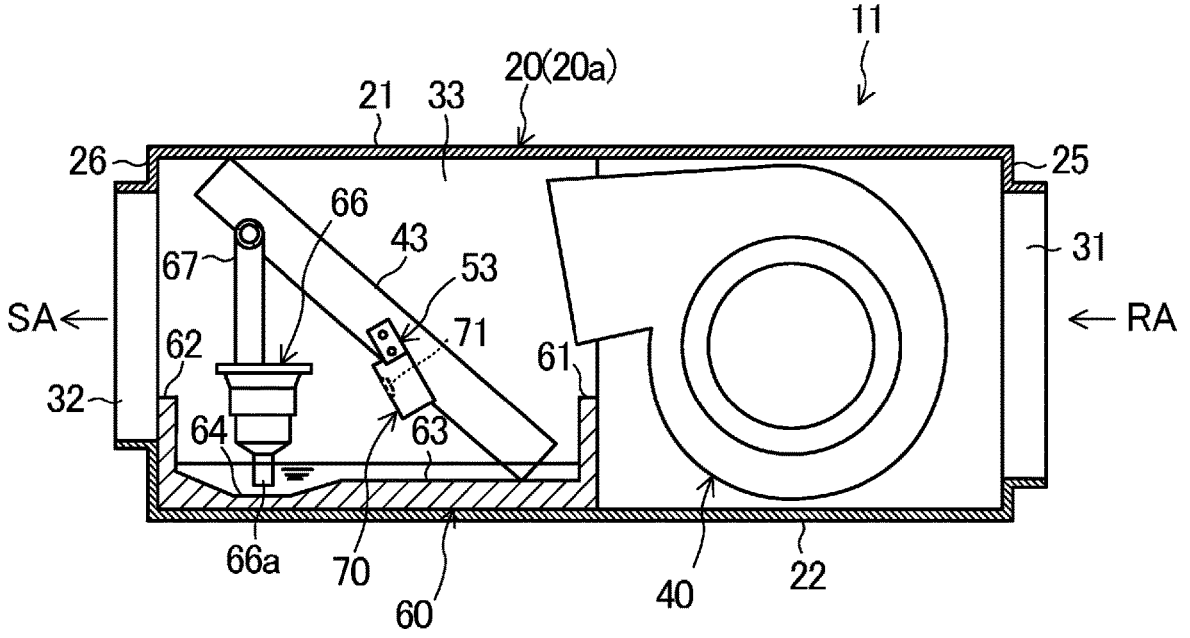
FIG. 3 is a longitudinal cross-sectional view illustrating an internal structure of the air-conditioning device according to the first embodiment.

As illustrated in FIGS. 1 to 3, the indoor unit (11) includes a casing (20) installed in the ceiling cavity, and a fan (40) and an indoor heat exchanger (43) both housed in the casing (20). The casing (20) includes therein a tray (60) (drain pan) for receiving condensed water generated from air in the casing (20), and a drain pump (66) for discharging water accumulated in the tray (60).

<Casing>

The casing (20) has the shape of a rectangular parallelepiped hollow box. The casing (20) includes a top plate (21), a bottom plate (22), a front plate (23), a rear plate (24), a first side plate (25), and a second side plate (26). The front plate (23) and the rear plate (24) face each other. The first side plate (25) and the second side plate (26) face each other.

The front plate (23) faces a maintenance space (15). An electric component box (16), an inspection hole (50), and an inspection cover (51) are provided on the front plate (23) side (the detail will be described later.) An suction port (31) is formed in the first side plate (25). A suction duct (not shown) is connected to the suction port (31). The inlet end of the suction duct communicates with an indoor space. A blowout port (32) is formed in the second side plate (26). A blowout duct (not shown) is connected to the blowout port (32). The blowout end of the exhaust duct is connected to the indoor space. The casing (20) has therein an air flow path (33) between the suction port (31) and the blowout port (32).

<Fan>

The fan (40) is disposed in a portion of the air flow path (33) near the first side plate (25). The fan (40) transfers air in the air flow path (33). In this embodiment, three sirocco fans (41) are driven by one motor (42) (see FIG. 1).

<Indoor Heat Exchanger>

The indoor heat exchanger (43) is disposed in a portion of the air flow path (33) near the second side plate (26). The indoor heat exchanger (43) is configured as, for example, a fin-and-tube heat exchanger. The indoor heat exchanger (43)

of this embodiment is arranged obliquely. The indoor heat exchanger (43) serving as an evaporator constitutes a cooling portion that cools air.

<Tray>

As schematically illustrated in FIG. 3, the tray (60) is disposed under the indoor heat exchanger (43) to extend along the bottom plate (22). The tray (60) receives water condensed in the vicinity of the indoor heat exchanger (43). The tray (60) includes a first side wall (61), a second side wall (62), and a bottom portion (63). The first side wall (61) is positioned upstream of the indoor heat exchanger (43). The second side wall (62) is located downstream of the indoor heat exchanger (43). The bottom portion (63) extends from the first side wall (61) to the second side wall (62). A bump (64) having a substantially trapezoidal cross section is formed in a center portion of the bottom portion (63). In the tray (60), the height of the bottom surface of this bump (64) is the lowest. Thus, the deepest portion is formed in the bump (64).

In this embodiment, the tray (60) is configured as an object to be imaged by a camera.

<Drain Pump>

A drain pump (66) is disposed inside the tray (60). The drain pump (66) is configured as a discharge portion for discharging water in the tray (60). Specifically, an inlet portion (66*a*) of the drain pump (66) is disposed inside the bump (64) of the tray (60). A discharge port of the drain pump (66) is connected to the inlet end of a drain pipe (67). The drain pipe (67) passes through the front plate (23) of the casing (20) in a horizontal direction. Operating the drain pump (66) causes condensed water accumulated in the tray (60) to be pumped up. The water pumped up is discharged to the outside of the casing (20) through the drain pipe (67).

In the first embodiment, the drain pump (66) is configured as an abnormality determination target part.

<Electric Component Box>

As illustrated in FIG. 1, the electric component box (16) is disposed on a portion of the front plate (23) near the fan (40). The electric component box (16) houses therein a printed board (17) on which a power supply circuit, a control circuit, and any other circuit are mounted, wires respectively connected to the circuits, a high-voltage power source, a low-voltage power source, and other components. The electric component box (16) includes a box body (16*a*) having a front surface with an opening, and an electric component cover (16*b*) opening and closing the opening surface of the box body (16*a*). The electric component cover (16*b*) forms a portion of the front plate (23). Detaching the electric component cover (16*b*) allows the inside of the electric component box (16) to be exposed to the maintenance space (15).

<Inspection Hole and Inspection Cover>

Figure 4:
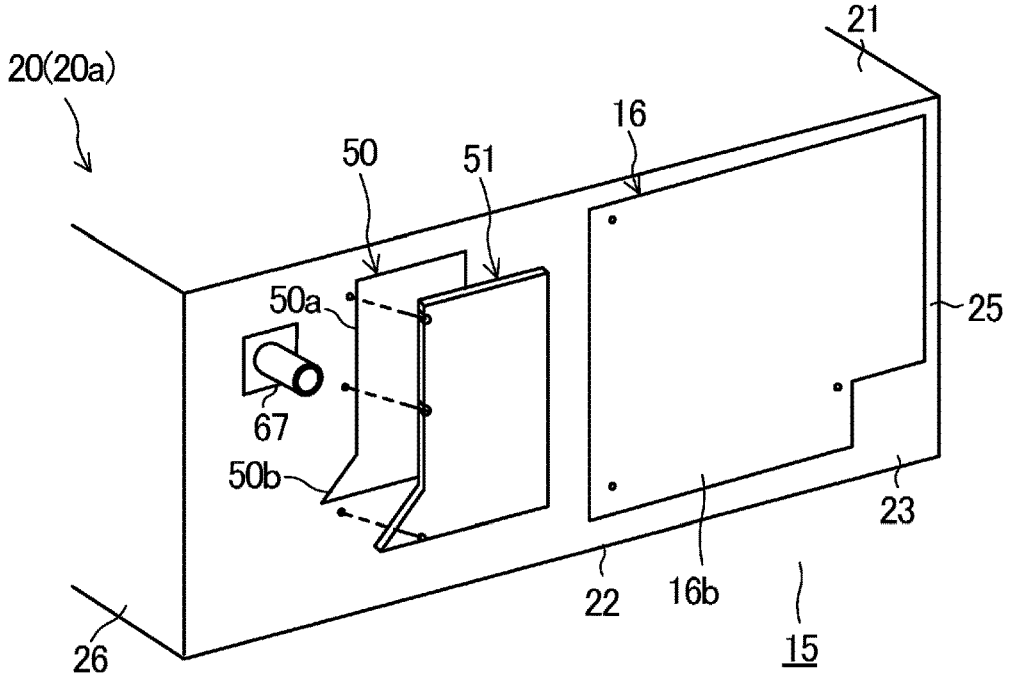
FIG. 4 is a perspective view illustrating a schematic configuration of the air-conditioning device according to the first embodiment on the front panel side.

As illustrated in FIG. 1, the inspection hole (50) is disposed in a portion of the front plate (23) near the indoor heat exchanger (43). As illustrated in FIGS. 2 and 4, the inspection hole (50) includes a rectangular portion (50*a*), and a triangular portion (50*b*) that is continuous with one lower corner of the rectangular portion. The triangular portion (50*b*) protrudes from the rectangular portion (50*a*) toward the second side plate (26). The inspection hole (50) is formed at a position corresponding to the tray (60). Detaching the inspection cover (51) from the inspection hole (50) allows the inside of the tray (60) to be inspected from the maintenance space (15).

The inspection cover (51) has a shape substantially similar to that of the inspection hole (50), and is slightly larger than the inspection hole (50). The inspection cover (51) has an edge portion having a plurality of (three in this example) fastening holes through which the inspection cover (51) is attached to the casing body (20*a*). The inspection cover (51) is fixed to the casing body (20*a*) through a plurality of fastening members (for example, bolts) inserted into, and run through, the fastening holes. Such a configuration allows the inspection cover (51) to be detachably attached to the casing body (20*a*) to open and close the inspection hole (50).

<Stay and Camera>

Figure 5:
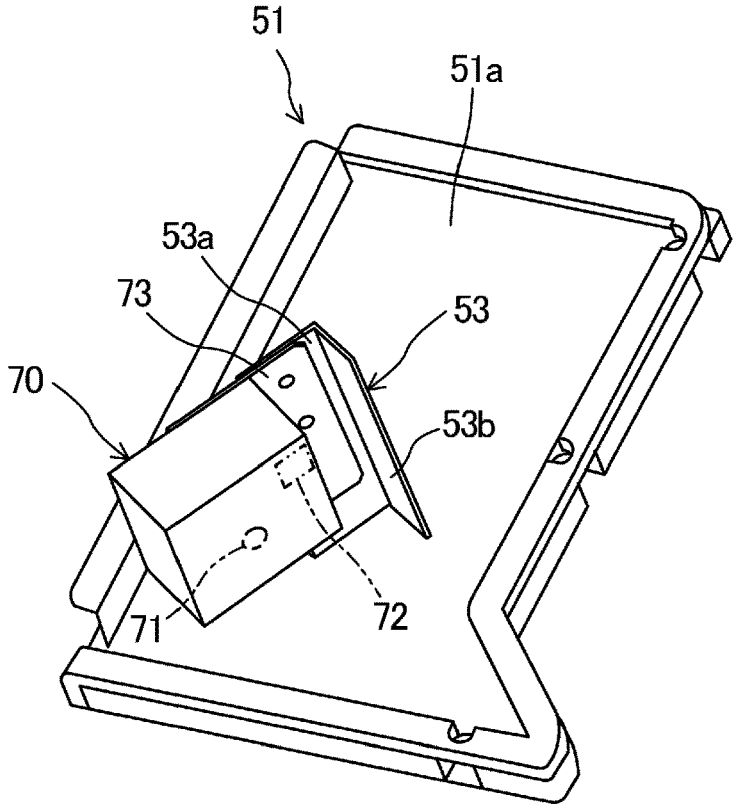
FIG. 5 is a perspective view illustrating an internal structure of an inspection cover according to the first embodiment.

As illustrated in FIG. 5, an inner wall (51*a*) of the inspection cover (51) is provided with a stay (53) for supporting a camera (70) on the inspection cover (51). The stay (53) is fixed to the inner wall (51*a*) of the inspection cover (51), and constitutes a support member to which the camera (70) is attached.

The stay (53) is fixed to a substantially central portion of the inner wall (51*a*) of the inspection cover (51), and extends in the horizontal direction. A base portion of the stay (53) may be welded to, for example, the inspection cover (51), or may be fastened to the inspection cover (51) via a plurality of bolts (fastening members). If the stay (53) is welded to the inspection cover (51), the inspection cover (51) does not have to have any fastening hole. This makes it easy for the inspection cover (51) to reliably have high sealing performance and high thermal insulation properties. On the other hand, if the stay (53) is fastened to the inspection cover (51) via the fastening members, the relative positions of the stay (53) and the inspection cover (51) can be reliably determined.

A cross section of the stay (53) perpendicular to the length of the stay (53) has a substantially L-shape. More specifically, the stay (53) includes a first plate portion (53*a*), and a second plate portion (53*b*) substantially perpendicular to the first plate portion (53*a*).

In a state where the inspection cover (51) is attached to the casing body (20*a*) (hereinafter simply referred to as the "attached state of the inspection cover (51)"), the stay (53) is disposed such that the junction between the first and second plate portions (53*a*) and (53*b*) faces upward. In the attached state of the inspection cover (51), a lower surface of the first plate portion (53*a*) faces the tray (60) (strictly speaking, the bump (64) of the tray (60)).

A camera (70) is detachably attached to the stay (53). The camera (70) constitutes an imaging device for imaging the target tray (60) to acquire image data. The camera (70) includes a lens (71) and a light emitting section (flash (72)). The lens is configured as a super-wide-angle lens. A support plate (73) is fixed to the back surface of the camera (70). The support plate (73) is fixed to the first plate portion (53*a*) of the stay (53) via a bolt (not shown). As a result, the camera (70) is supported by the stay (53) and thus by the inspection cover (51).

With the inspection cover (51) attached, the lens (71) of the camera (70) faces the inside of the tray (60). That is to say, with the inspection cover (51) attached, the camera (70) is positioned such that the camera (70) can image the height of the height of the water surface in the tray (60) (see FIG. 3.)

<Imaging System>

Figure 6:
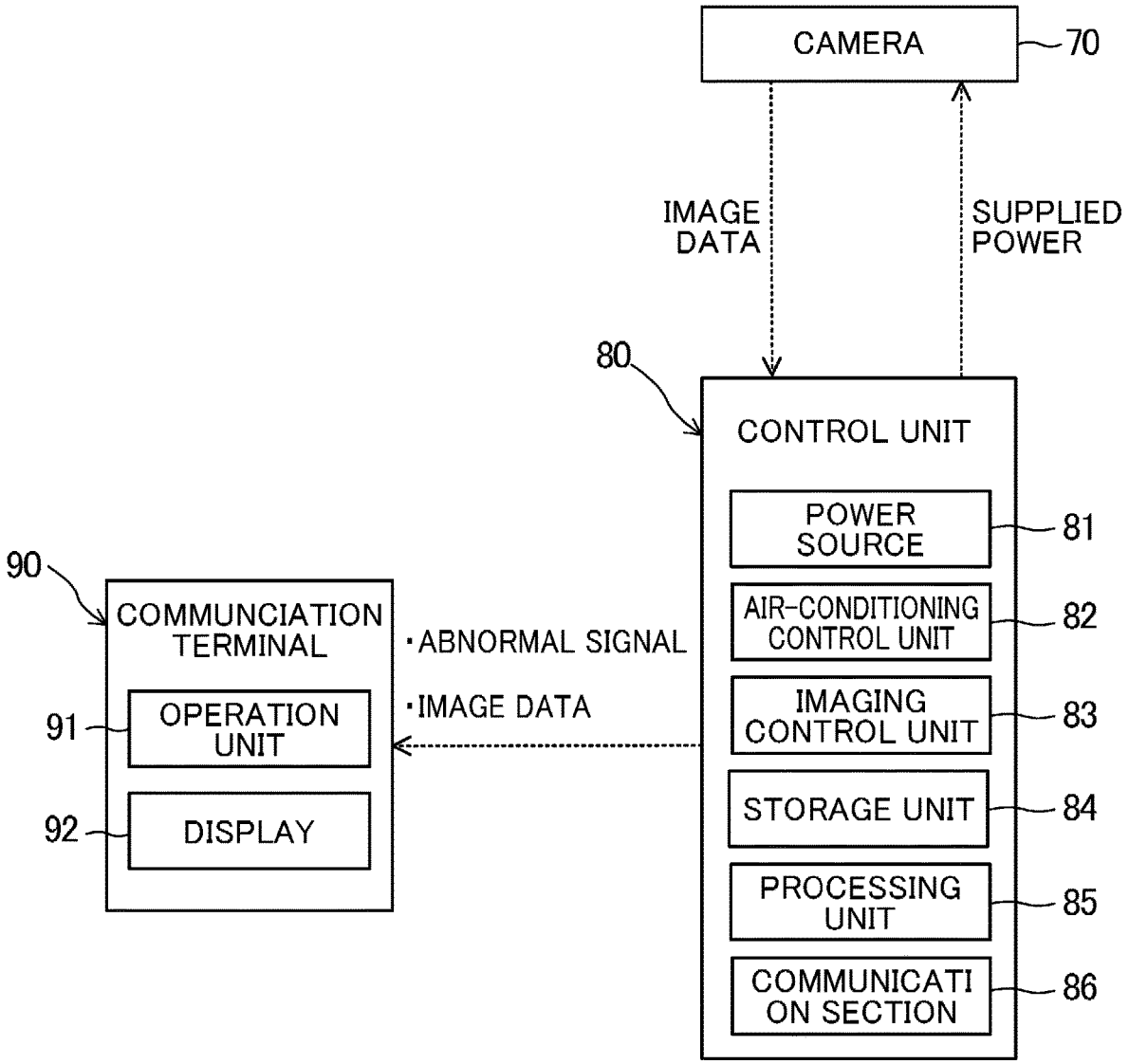
FIG. 6 is a block diagram schematically illustrating an imaging system according to the first embodiment.

An imaging system (S) according to this embodiment will be described with reference to FIG. 6. The imaging system (S) according to this embodiment includes a camera (70), a control unit (80), and a communication terminal (90). As mentioned above, the casing (20) of the air-conditioning device (10) houses the camera (70). An electric component box (16) houses the control unit (80). The camera (70) and the control unit (80) are connected by a cable. The communication terminal (90) is owned by a service provider, a user, or the like of the air-conditioning device (10).

The control unit (80) includes a power source (81), an air-conditioning control unit (82), an imaging control unit (83), a storage unit (84), a processing unit (85), and a communication section (86). The imaging control unit (85) includes a microcomputer and a memory device (specifically, a semiconductor memory) that stores software for operating the microcomputer.

The power source (81) is configured as a power source for the camera (70). The power source (81) supplies power to the camera (70) via a cable.

The air-conditioning control unit (82) controls each component such as a fan (40) of the air-conditioning device (10) and the drain pump (66). When the air-conditioning device (10) starts the cooling operation, the air-conditioning control unit (82) operates the drain pump (66), and when the air-conditioning device (10) stops the cooling operation, the air-conditioning control unit (82) stops the operation of the drain pump (66). That is, during the cooling operation, the drain pump (66) also is basically in operation.

The imaging control unit (83) controls imaging by the camera (70). Specifically, the imaging control unit (83) supplies power from the power source (81) to the camera (70) in order to execute imaging by the camera (70). When power is supplied to the camera (70), the camera (70) executes imaging. The imaging control unit (83) may output an ON signal in order to make the camera (70) capture an image. In this case, when the ON signal is input to the camera (70), the camera (70) captures an image. When the camera (70) captures an image, image data of an object to be imaged is acquired. The image data is input to the control unit (80) via a cable.

The storage unit (84) is configured as a storage medium that stores the image data acquired by the camera (70).

The processing unit (85) determines an abnormality of a predetermined part (the drain pump (66) in this example) on the basis of a plurality of image data stored in the storage unit (84). The processing unit (85) determines an abnormality of the drain pump (66) on the basis of the change in the image data. In this determination, the deep learning of the AI (artificial intelligence) based on the accumulated image data may be used.

The communication section (86) is connected to communication terminal (90) in a wireless manner, for example. The communication section (86) is connected to communication terminal (90) via a communication line using a mobile high-speed communication technology (LTE). Thus, signals can be exchanged between the control unit (80) and the communication terminal (90). The communication section (86) may be a wireless router connected to the communication terminal (90) using a wireless LAN. When an abnormality is determined in the processing unit (85), a signal (abnormal signal) indicating an abnormality is transmitted to the communication terminal (90) via the communication section (86).

The communication terminal (90) is configured as a smartphone, a tablet terminal, a mobile phone, a personal computer, or the like. The communication terminal (90) includes an operation unit (91), a display (92), and an alarm unit (93). The operation unit (91) is configured as a keyboard, a touch panel, or the like. The service provider or any other operator operates the operation unit (91) to operate predetermined application software. Via this application software, the camera (70) can be made to capture an image, and the acquired image data can be downloaded to the communication terminal (90).

The display (92) is configured as, for example, a liquid crystal monitor. When an abnormality signal is input to the communication terminal (90), a sign indicating that the predetermined part (the drain pump (66) in this example) has an abnormality is displayed on the display (92).

When an abnormality signal is input to the communication terminal (90), the alarm unit (93) emits an alarm (sound) indicating the input.

—Operation—

A basic operation of the air-conditioning device (10) according to the first embodiment is described below. The air-conditioning device (10) is configured to be capable of performing a cooling operation and a heating operation.

In the cooling operation, a refrigerant compressed by the compressor of the outdoor unit dissipates heat (condenses) in the outdoor heat exchanger, and is decompressed at an expansion valve. The decompressed refrigerant evaporates in the indoor heat exchanger (43) of the indoor unit (11), and is again compressed by the compressor.

When the fan (40) is operated, room air (RA) in the indoor space is sucked into the air flow path (33) through the suction port (31). The air in the air flow path (33) passes through the indoor heat exchanger (43). In the indoor heat exchanger (43), the refrigerant absorbs heat from the air, thereby cooling the air. The cooled air passes through the blowout port (32), and is then supplied as supply air (SA) to the indoor space.

If the air is cooled to a temperature equal to or lower than the dew point in the indoor heat exchanger (43), water in the air condenses. A tray (60) receives this condensed water. The condensed water received by the tray (60) is discharged to the outside of the casing (20) by the drain pump (66).

In the heating operation, a refrigerant compressed by the compressor of the outdoor unit dissipates heat (condenses) in the indoor heat exchanger (43) of the indoor unit (11), and is decompressed at an expansion valve. The decompressed refrigerant evaporates in the outdoor heat exchanger of the outdoor unit, and is again compressed by the compressor. In the indoor heat exchanger (43), the refrigerant dissipates heat to the air, thereby heating the air. The heated air is then supplied to the indoor space as supply air (SA) through the blowout port (32).

<Basic Operation of Imaging System>

A basic operation of an imaging system (S) is described below. With the inspection cover (51) attached, the lens (71) of the camera (70) is directed to the inside of the tray (60). When the camera (70) is turned ON in this state, the camera (70) captures an image. In this imaging, a flash (72) (light source) is operated to illuminate the inside of the tray (60). Accordingly, the camera (70) acquires image data of the water surface in the tray (60). Image data acquired by the camera (70) is input to the control unit (80) via a cable and is stored in the storage unit (84), as appropriate.

<Control of Abnormality Determination for Drain Pump>

Figure 7:
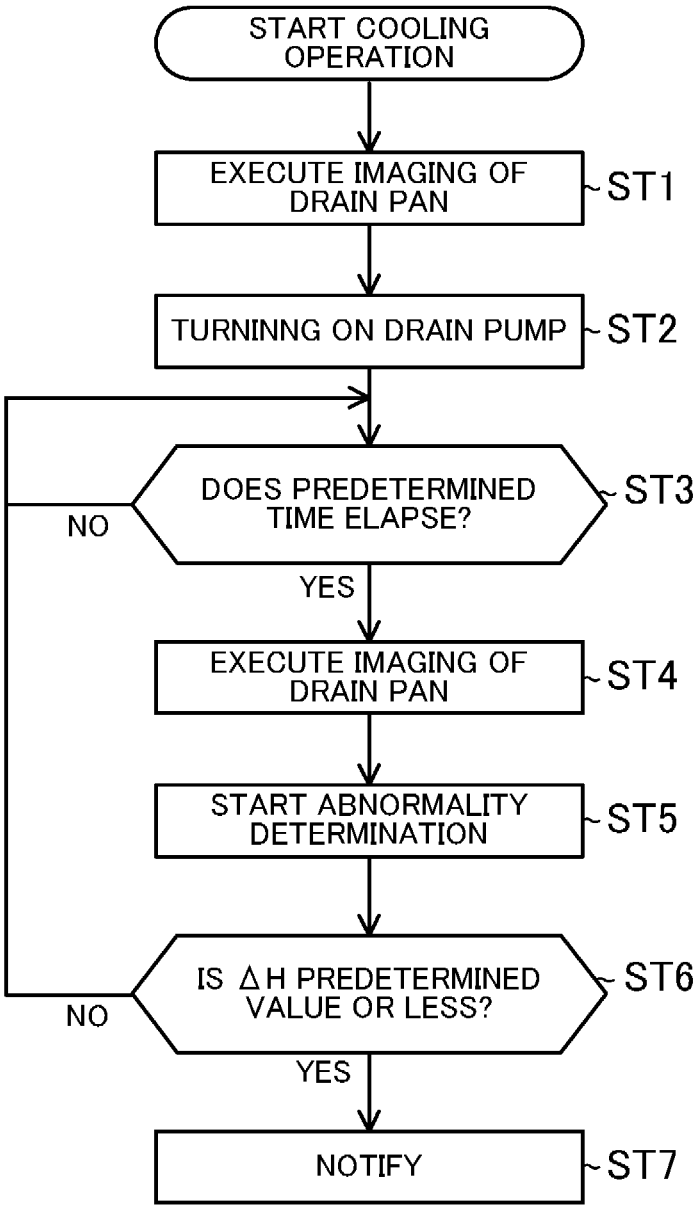
FIG. 7 is a flowchart showing an abnormality determination according to the first embodiment.

The imaging system (S) determines an abnormality in the drain pump (66) on the basis of a plurality of image data acquired by the camera (70). This control is described below with reference to FIGS. 6 to 8.

When the air-conditioning device (10) starts a cooling operation in response to a command from a remote controller or the like, the imaging control unit (83) controls the camera (70) to capture an image after predetermined time Δta from this command to start cooling operation (Step ST1). Thereafter, the air-conditioning control unit (82) turns ON the drain pump (66) (Step St 2). That is, the air-conditioning control unit (82) turns ON the drain pump (66) after predetermined time Δtb (here Δtb>Δta) from the command to start cooling operation. Accordingly, in this example, image data of the water surface in the tray (60) is acquired at the first point in time t1 before actuation of the drain pump (66). The camera (70) may acquire image data of the water surface in the tray (60) at the first point in time t1 at the actuation of the drain pump (66). Before or at the actuation of the drain pump (66), the height of the water surface in the tray (60) becomes relatively high. This is because condensed water is accumulated in the tray (60) during a time period after the stop of a previous cooling operation by the air-conditioning device (10) and before the start of a subsequent cooling operation.

After predetermined time T1 elapses in the step ST3 from execution of the imaging at the first point in time t1, a subsequent imaging is executed (Step ST4). This predetermined time T1 corresponds to time until water in the tray (60) at the actuation of the drain pump (66) reaches the lowest height of the water surface when the drain pump (66) normally operates. This lowest height of the water surface corresponds to the height of the opening at the lower end of the inlet portion (66*a*) of the drain pump (66) (see FIG. 3).

After image data of the water surface in the tray (60) is acquired in the Step ST4, an abnormality is determined by the processing unit (85) (Step ST5). The processing unit (85) determines the height h1 of the water surface in the image data at the first point in time t1 and the height h2 of the water surface in the image data at the second point in time t2 and determines an abnormality of the drain pump (66) on the basis of the change between the heights h1 and h2. Specifically, the processing unit (85) calculates the difference (ΔH) between the heights h1 and h2, and whether this difference ΔH is a predetermined value A or less is determined.

Figure 8:
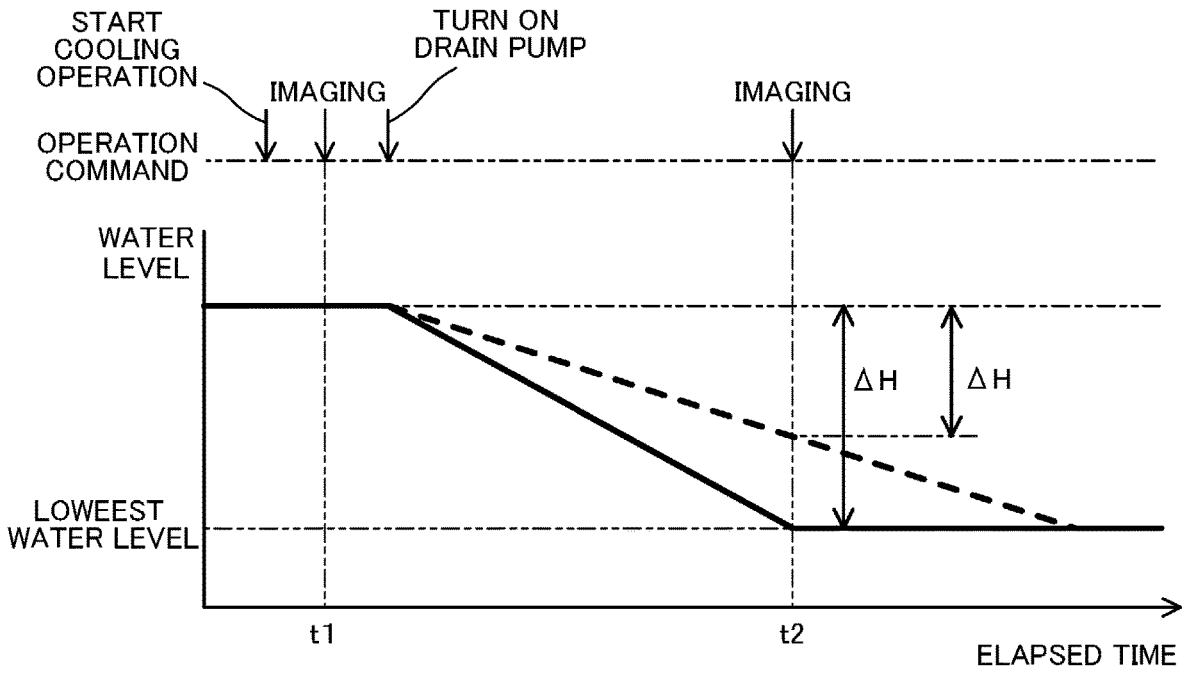
FIG. 8 is a time chart representing the height of the water surface in a tray and each timing for command in the abnormality determination according to the first embodiment.

As indicated by a solid line in FIG. 8, when the drain pump (66) is operating normally, the height of the water surface decreases at a relatively high rate after the actuation of the drain pump (66). Therefore, ΔH becomes relatively large. On the other hand, for example, as indicated by a dashed line in FIG. 8, when the drain pump (66) has an abnormality, and the suction amount by the drain pump (66) decreases, the height of the water surface in the tray (60) is reduced at a relatively low rate. Further, when the drain pump (66) has an abnormality, the height of the water surface in the tray (60) may not at all decrease in some cases. As described above, when the drain pump (66) has an abnormality, ΔH becomes relatively small. Therefore, by determining whether ΔH is a predetermined value A or less, whether the drain pump (66) has an abnormality can be determined.

When it is determined that ΔH is a predetermined value A or less in the Step ST6, the Step ST7 is conducted. In the Step ST7, the communication section (86) outputs an abnormal signal to the communication terminal (90). Accordingly, the communication terminal (90) brings a sign indicating an abnormality to be displayed on the display (92) and brings an alarm to be generated by the alarm unit (93). Therefore, the maintenance provider or the like can quickly know that the drain pump (66) has an abnormality.

—Advantages of First Embodiment—

In the first embodiment, the processing unit (85) determines an abnormality of the predetermined part (drain pump (66)) on the basis of the change in a plurality of image data of an object (tray (60)) to be imaged. That is, the processing unit (85) determines the abnormality of the drain pump (66) considering not one image data, but the state change in the plurality of image data. Thus, even if features of the image data are changed by the type of the tray (60) and the installation state of the camera (70), an abnormality of the drain pump (66) can be accurately determined on the basis of the change in the plurality of image data. That is, this embodiment can reduce an erroneous determination due to the individual difference between objects to be imaged.

In the first embodiment, an abnormality of the drain pump (66) is determined on the basis of the change (ΔH) between the height h1 of the water surface in the tray (60) at the first point in time which is before or at the actuation of the drain pump (66) and the height h2 of the water surface in the tray (60) during the first time period until the second point in time which is after the actuation of the drain pump (66). The height h1 of the water surface before or at the actuation of the drain pump (66) generally largely differs from the height h2 of the water surface after the actuation of the drain pump (66). Thus, an abnormality of the drain pump (66) can be determined by considering the change in height of the water surface.

<Variation of First Embodiment>

An abnormal determination for the drain pump (66) in the first embodiment may have the following variation. The imaging system (S) of the present variation determines an abnormality of a drain pump (66) on the basis of a predetermined image data acquired during the second time period after actuation of the drain pump (66).

Figure 9:
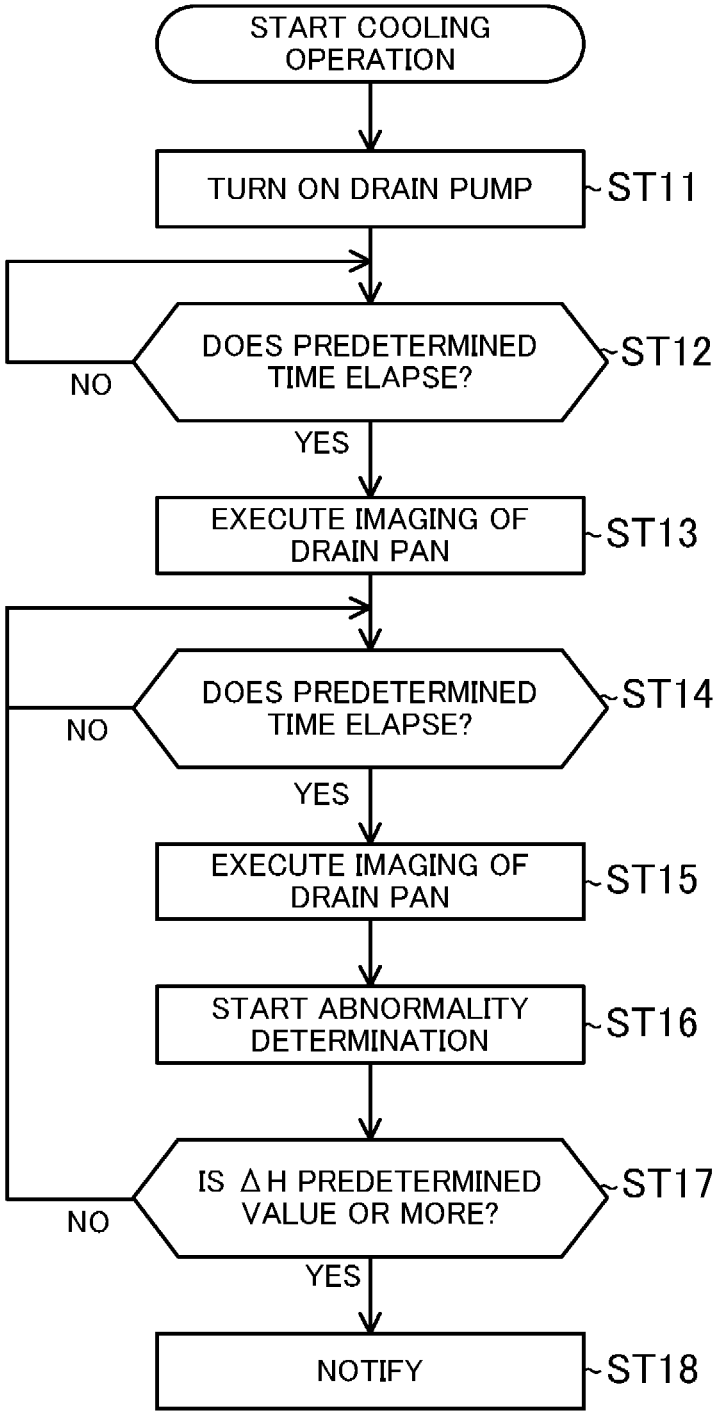
FIG. 9 is a flowchart showing an abnormality determination according to a variation of the first embodiment.
Figure 10:
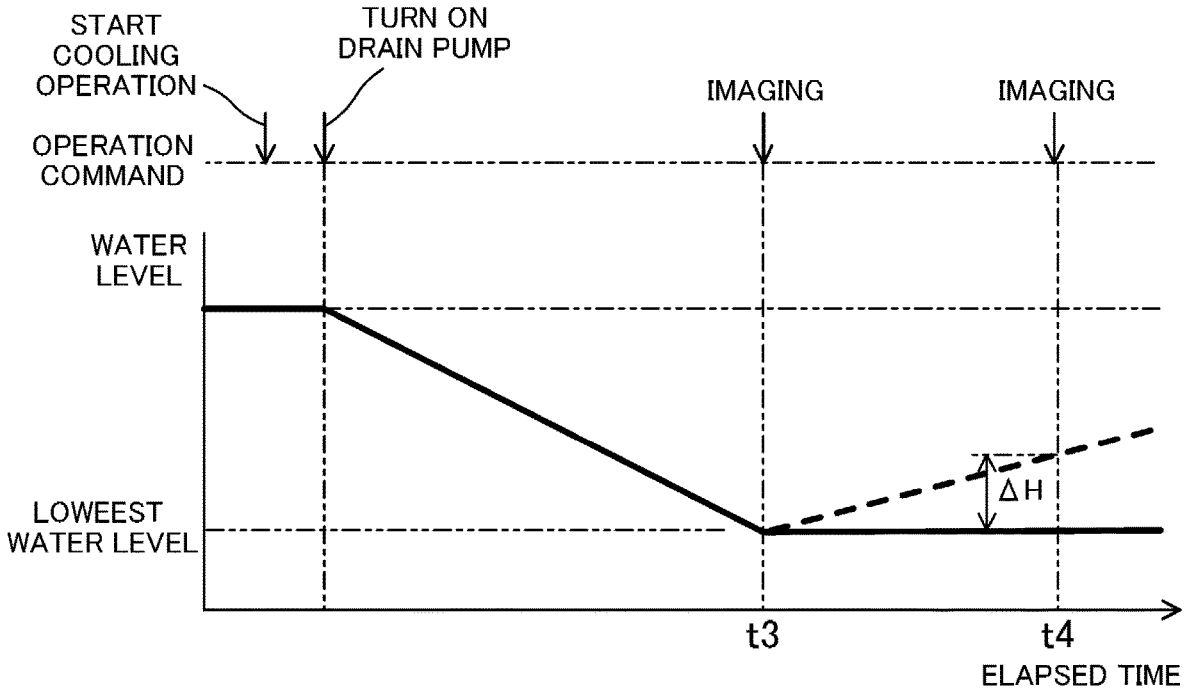
FIG. 10 is a time chart representing the height of the water surface in a tray and each timing for command in the abnormality determination according to the variation of the first embodiment.

As illustrated in FIGS. 9 and 10, when the air-conditioning device (10) starts a cooling operation in response to a command from a remote controller or the like, the drain pump (66) is turned ON with the start of the cooling operation (Step ST11). After predetermined time T2 elapses in the Step ST12 from turning ON of the drain pump (66), image data of the water surface in the tray (60) is acquired at the third point in time t3 (Step ST13). This predetermined time T2 corresponds to time slightly longer than time until water in the tray (60) at the actuation of the drain pump (66) reaches the lowest height of the water surface when the drain pump (66) normally operates. Therefore, the height of the water surface in the image data at the third point in time t3 is basically the lowest height of the water surface.

In the Step ST14, after predetermined time T3 elapses from the third point in time t3, image data of the water surface in the tray (60) is acquired at the fourth point in time t4 (Step ST15). Subsequently, in the Step ST16, an abnormality of the drain pump (66) is determined.

When the drain pump (66) operates normally after the third point in time t3, water received in the tray (60) is always drawn into the drain pump (66). Accordingly, the height of the water surface in the tray (60) is kept at the lowest height of the water surface (see a solid line in FIG. 10). Thus, the amount of change ΔH (ΔH=h4−h3) between the height h3 of the water surface at the point in time t3 and the height h4 of the water surface at the point in time t4 is substantially zero.

On the other hand, when the drain pump (66) has an abnormality after the third point in time t3, the suction amount by the drain pump (66) decreases, and the height of the water surface in the tray (60) increases (see a broken line in FIG. 10). Thus, the amount of change ΔH (ΔH=h4−h3) between the height h3 of the water surface at the point in time t3 and the height h4 of the water surface at the point in time t4 increases. Therefore, by determining whether ΔH is a predetermined value B or more, whether the drain pump (66) has an abnormality can be determined.

When it is determined that ΔH is a predetermined value B or more in the Step ST17, the Step ST18 is conducted. In the Step ST18, the communication section (86) outputs an abnormal signal to the communication terminal (90). Accordingly, the communication terminal (90) brings a sign indicating an abnormality to be displayed on the display (92) and brings an alarm to be generated by the alarm unit (93). Therefore, the maintenance provider or the like can quickly know that the drain pump (66) has an abnormality.

Second Embodiment

The air-conditioning device (10) according to the second embodiment has a basic configuration different from the first embodiment. The air-conditioning device (10) according to the second embodiment takes outdoor air (OA) in and adjusts the temperature and humidity of the air. The air-conditioning device (10) supplies the air thus treated as supply air (SA) into the room. That is to say, the air-conditioning device (10) is an outside air treatment system. The air-conditioning device (10) includes a humidifier (45) for humidifying air, for example, in the winter season.

The air-conditioning device (10) is installed in a space in the ceiling cavity. Just like the first embodiment, the air-conditioning device (10) includes an outdoor unit (not shown) and an indoor unit (11), which are connected together through refrigerant pipes to form a refrigerant circuit.

<Indoor Unit>

Figure 11:
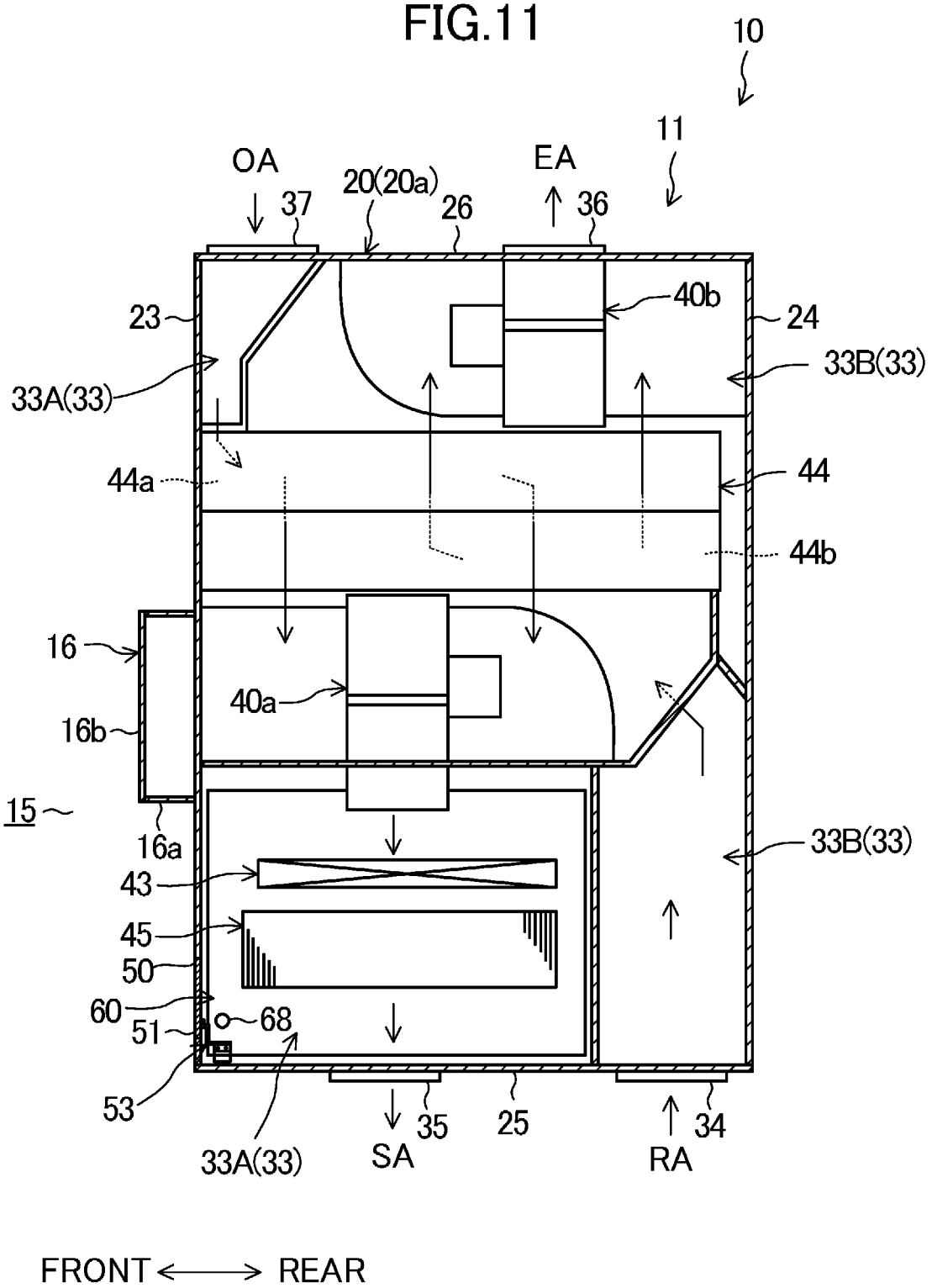
FIG. 11 is a plan view illustrating an internal structure of an air-conditioning device according to the second embodiment.
Figure 12:
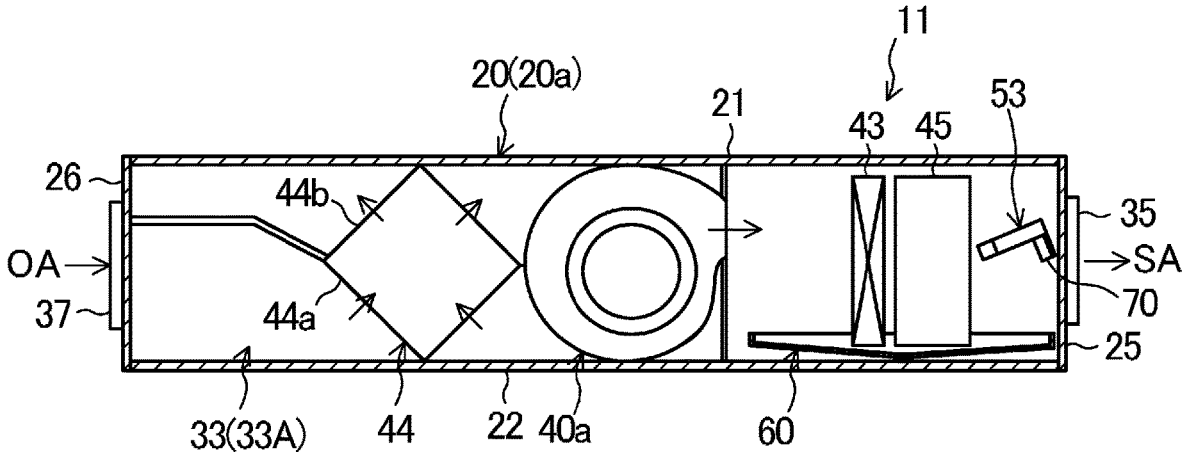
FIG. 12 is a longitudinal cross-sectional view illustrating an internal structure of the air-conditioning device according to the second embodiment.

As illustrated in FIGS. 11 and 12, the indoor unit (11) includes a casing (20) installed in the ceiling cavity, an air supply fan (40*a*), an exhaust fan (40*b*), an indoor heat exchanger (43), a total heat exchanger (44), and the humidifier (45). The casing (20) includes therein a tray (60) collecting condensed water generated at the indoor heat exchanger (43), and an drain port (68) (discharge part) for discharging water accumulated in tray (60).

<Casing>

The casing (20) has the shape of a rectangular parallelepiped hollow box. Just like the first embodiment, the casing (20) of the second embodiment includes a top plate (21), a bottom plate (22), a front plate (23), a rear plate (24), a first side plate (25), and a second side plate (26).

The front plate (23) faces a maintenance space (15). The front plate (23) is provided with an electric component box (16), an inspection hole (50), and an inspection cover (51) (which will be described in detail below). The first side plate (25) has an inside air port (34) and an air supply port (35). The inside air port (34) is connected to an inside air duct (not shown). The inlet end of the inside air duct communicates with the indoor space. The air supply port (35) is connected to an air supply duct (not shown). The blowout end of the air supply duct communicates with the indoor space. The second side plate (26) has an exhaust port (36) and an outside air port (37). The exhaust port (36) is connected to an exhaust duct (not shown). The blowout end of the exhaust duct communicates with the outdoor space. The outside air port (37) is connected to an outside air duct (not shown). The inlet end of the outside air duct communicates with the outdoor space.

The casing (20) has therein an air supply path (33A) and an exhaust path (33B). The air supply path (33A) extends from the outside air port (37) to the air supply port (35). The exhaust path (33B) extends from the inside air port (34) to the exhaust port (36).

<Total Heat Exchanger>

The total heat exchanger (44) has a horizontally long quadrangular prism shape. The total heat exchanger (44) includes, for example, two types of sheets alternately stacked in the horizontal direction. The sheets of one of the two types form a first passage (44*a*) communicating with the air supply path (33A). The sheets of the other type form a second passage (44*b*) communicating with the exhaust path (33B). Each sheet is made of a material having heat transfer and hygroscopic properties. Thus, the total heat exchanger (44) exchanges latent heat and sensible heat between the air flowing through the first passage (44*a*) and the air flowing through the second passage (44*b*).

<Air Supply Fan>

An air supply fan (40*a*) is disposed in the air supply path (33A) to transfer the air in the air supply path (33A). More specifically, the air supply fan (40*a*) is disposed in a portion of the air supply path (33A) between the first passage (44*a*) of the total heat exchanger (44) and the indoor heat exchanger (43).

<Exhaust Fan>

An exhaust fan (40*b*) is disposed in the exhaust path (33B) to transfer the air in the exhaust path (33B). More specifically, the exhaust fan (40*b*) is disposed in a portion of the exhaust path (33B) downstream of the second passage (44*b*) of the total heat exchanger (44).

<Indoor Heat Exchanger>

An indoor heat exchanger (43) is disposed in a portion of the air supply path (33A) near the front plate (23). The indoor heat exchanger (43) is configured as, for example, a fin-and-tube heat exchanger.

<Humidifier>

A humidifier (45) is disposed in a portion of the air supply path (33A) near the front plate (23). The humidifier (45) is disposed in a portion of the air supply path (33A) downstream of the indoor heat exchanger (43). The humidifier (45) includes a plurality of vertically extending hygroscopic members (45*a*) in the horizontal direction. Water from a water supply tank (not shown) is supplied to these hygroscopic members (45*a*). In the humidifier (45), evaporated air is applied to air flowing around the hygroscopic members (45*a*). The air flowing through the air supply path (33A) is humidified in this manner.

<Tray>

As schematically illustrated in FIG. 12, a tray (60) is disposed below a humidifier (45). The tray (60) receives water (humidifying water) flown out of the humidifier (45). An drain port (68) is provided at a lower portion of the tray (60).

In the second embodiment, the drain port (68) is configured as an abnormality determination target part.

<Electric Component Box>

Figure 13:
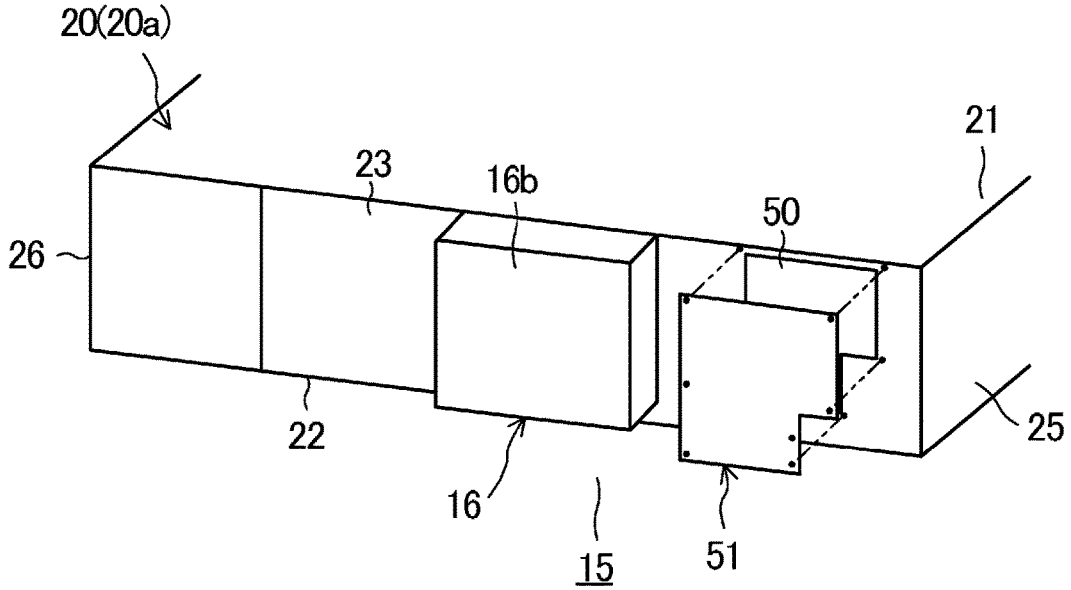
FIG. 13 is a perspective view illustrating a schematic configuration of the air-conditioning device according to the second embodiment on the front panel side.

As illustrated in FIGS. 11 and 13, the electric component box (16) is provided on a substantially central portion of a front surface of the front plate (23). The electric component box (16) houses therein electric components similar to those in the first embodiment.

<Inspection Hole and Inspection Cover>

As illustrated in FIG. 13, the inspection hole (50) is formed in a portion of the front plate (23) near the indoor heat exchanger (43) and the humidifier (45). The inspection hole (50) is formed at a position corresponding to the tray (60) and the humidifier (45). Detaching the inspection cover (51) from the inspection hole (50) allows the inside of the tray (60) and the humidifier (45) to be inspected from the maintenance space (15).

The inspection cover (51) is attached to the casing body (20*a*) through a plurality of fastening members. That is to say, just like the second embodiment, the inspection cover (51) is detachably attached to the casing body (20*a*) to open and close the inspection hole (50).

<Stay and Camera>

Figure 14:
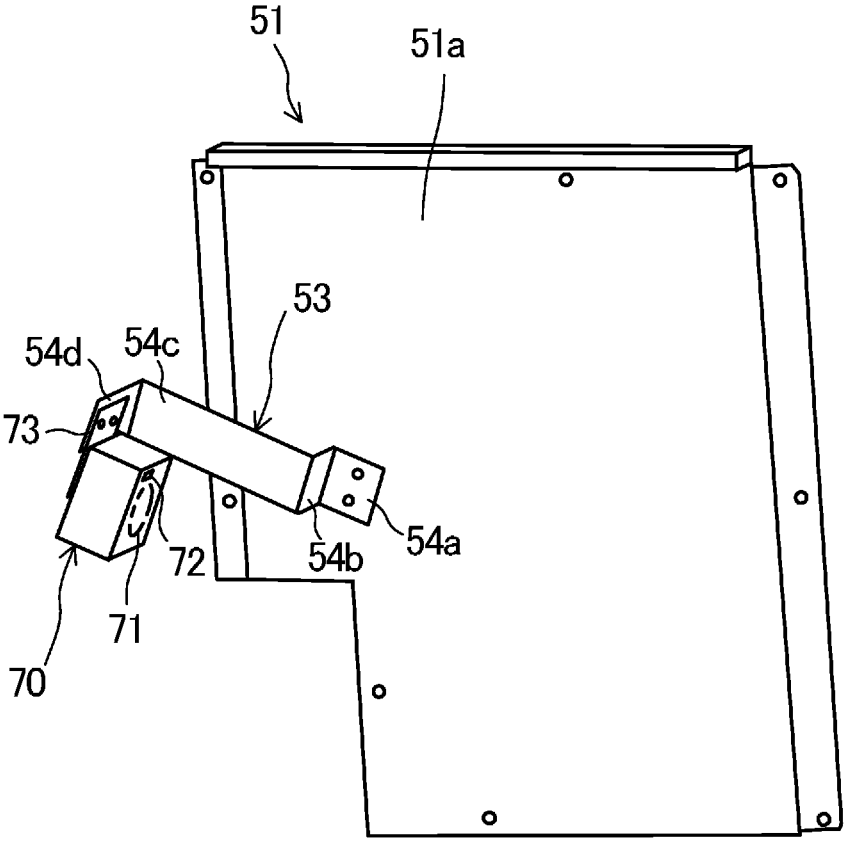
FIG. 14 is a perspective view illustrating an internal structure of an inspection cover according to the second embodiment.

As illustrated in FIG. 14, an inner wall (51*a*) of the inspection cover (51) is provided with a stay (53) for supporting a camera (70) on the inspection cover (51). The stay (53) is fixed to a substantially central portion of the inner wall (51*a*) of the inspection cover (51), and extends in the horizontal direction. A base portion of the stay (53) may be welded to, for example, the inspection cover (51), or may be fastened to the inspection cover (51) via a plurality of bolts (fastening members).

The stay (53) of the second embodiment is a sheet metal folded in a stepwise manner. The stay (53) includes a fixing plate portion (54*a*), a perpendicular plate portion (54*b*), a lateral plate portion (54*c*), and a mounting plate portion (54*d*), which are connected together in this order from its base portion toward its distal end. The fixing plate portion (54*a*) is formed along the inner wall (51*a*) of the inspection cover (51), and is fixed to the inner wall (51*a*) through a plurality of (in this example, two) fastening members (55) (bolts or any other tools). The perpendicular plate portion (54*b*) extends from the inner wall (Ma) of the inspection cover (51) toward the rear plate (24) of the casing (20). The lateral plate portion (54*c*) is parallel to the inner wall (51*a*) of the inspection cover (51), and extends obliquely upward from the base portion of the stay (53). The mounting plate portion (54*d*) extends from the lateral plate portion (54*c*) toward the rear plate (24) of the casing (20). The mounting plate portion (54*d*) faces obliquely downward so as to be directed to a lowest portion of the bottom portion (63) of the tray (60).

A camera (70) is detachably attached to the stay (53). A support plate (73) is fixed to the back surface of the camera (70). The support plate (73) is fixed to the mounting plate portion (54*d*) of the stay (53) via bolts (not shown). The support plate (73) is fixed to the attaching plate portion (54*d*) of the stay (53) by welding. As a result, the camera (70) is supported by the stay (53) and thus by the inspection cover (51). The basic configuration of the camera (70) is the same as that of the first embodiment.

While the inspection cover (51) is attached to the casing body (20*a*), the lens (71) of the camera (70) is directed to the inside of the tray (60). That is, with the inspection cover (51) attached, the camera (70) is positioned such that the camera (70) can image the height of the water surface in the tray (60).

—Operation—

A basic operation of the air-conditioning device (10) according to the second embodiment will be described with reference to FIGS. 11 and 12. The air-conditioning device (10) is configured to be capable of performing a cooling operation and a heating operation.

Just like the first embodiment described above, while the indoor heat exchanger (43) serves as an evaporator in the cooling operation, the indoor heat exchanger (43) serves as a condenser (a radiator) in the heating operation. In the heating operation, the humidifier (45) operates to humidify air. In the cooling operation and the heating operation, when the air supply fan (40*a*) and the exhaust fan (40*b*) operate, outdoor air (OA) is introduced through the outside air port (37) into the air supply path (33A), and at the same time, room air (RA) is introduced through the inside air port (34) into the exhaust path (33*b*). Thus, an indoor space is ventilated.

In the cooling operation, the outdoor air (OA) introduced into the air supply path (33A) flows through the first passage (44*a*) of the total heat exchanger (44). Meanwhile, the room air (RA) introduced into the exhaust path (33B) flows through the second passage (44*b*) of the total heat exchanger (44). For example, in the summer season, the outdoor air (OA) has a higher temperature and a higher humidity than the room air (RA). For this reason, latent heat and sensible heat of the outdoor air (OA) are given to the room air (RA) in the total heat exchanger (44). As a result, the air is cooled and dehumidified in the first passage (44*a*). In the second passage (44*b*), the air to which latent heat and sensible heat are given passes through the exhaust port (36), and is discharged as exhaust air (EA) to the outdoor space.

The air cooled and dehumidified in the first passage (44*a*) is cooled in the indoor heat exchanger (43), and then passes through the humidifier (45) at rest. Thereafter, the air passes through the air supply port (35), and is supplied as supply air (SA) to the indoor space.

In the heating operation, the outdoor air (OA) introduced into the air supply path (33A) flows through the first passage (44*a*) of the total heat exchanger (44). Meanwhile, the room air (RA) introduced into the exhaust path (33B) flows through the second passage (44*b*) of the total heat exchanger (44). For example, in the winter season, the outdoor air (OA) has a lower temperature and a lower humidity than the room air (RA). For this reason, latent heat and sensible heat of the room air (RA) are given to the outdoor air (OA) in the total heat exchanger (44). As a result, the air is heated and humidified in the first passage (44*a*). In the second passage (44*b*), the air from which latent heat and sensible heat are taken passes through the exhaust port (36), and is discharged as exhaust air (EA) to the outdoor space.

The air heated and humidified in the first passage (44*a*) is heated in the indoor heat exchanger (43), and then passes through the humidifier (45). The humidifier (45) gives water vaporized through the hygroscopic materials to the air, which is further humidified. The air that has passed through the humidifier (45) passes through the air supply port (35), and is supplied as supply air (SA) to the indoor space.

<Operation of Imaging System>

With the inspection cover (51) attached, the lens (71) of the camera (70) is directed to the inside of the tray (60). In this state, power is supplied to the camera (70) to perform imaging of the camera (70). In this imaging, a flash (72) is operated to illuminate the inside of the tray (60). Accordingly, image data of the water surface in the tray (60) is acquired.

<Control of Abnormality Determination for Drain Port>

The imaging system (S) determines an abnormality in the drain port (68) (more strictly, clogging of the drain port (68)) on the basis of a plurality of image data acquired by the camera (70).

Figure 15:
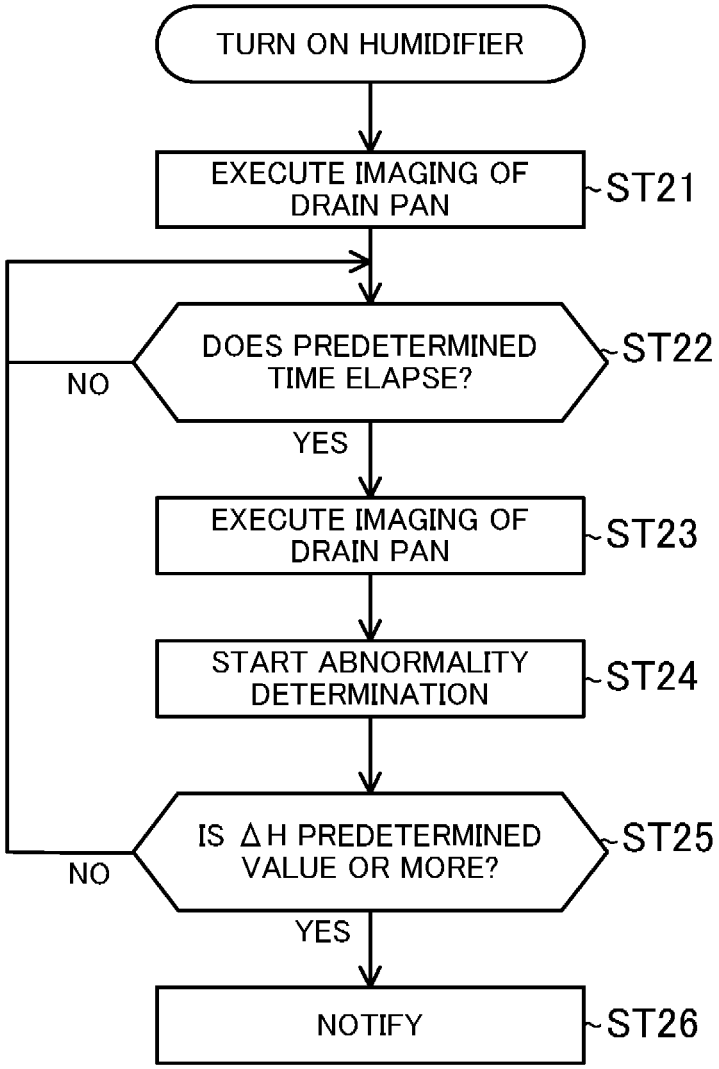
FIG. 15 is a flowchart showing an abnormality determination according to the second embodiment.

As illustrated in FIG. 15, when a humidifier (45) is turned ON, an imaging control unit (83) brings a camera (70) to execute imaging in synchronization with the humidifier (45) operation start command (Step ST21). Accordingly, image data of the water surface in the tray (60) is acquired at the point in time t5. A humidifying water in the tray (60) is discharged from the drain port (68) to the outside. That is, during the on-state of the humidifier (45), there is only a little humidifying water in the tray (60), and the height of the water surface in the tray (60) is substantially zero. The point in time t5 is not limited to only be immediately after the actuation of the humidifier (45) and may be at or before the actuation of the humidifier (45).

After the predetermined time T4 elapses from the point in time t5 (Step ST22), image data of the water surface in the tray (60) is acquired at the point in time t6. Subsequently, the Step ST24 is conducted to determine an abnormality of the drain port (68).

When the drain port (68) functions normally, and water in the tray (60) is sufficiently discharged, the height h6 of the water surface in the tray (60) at the point in time t6 is identical to the height h5 of the water surface at the point in time t5, which is substantially zero. On the other hand, when the drain port (68) has an abnormality (is clogged), and water in the tray (60) cannot be discharged, the height h6 of the water surface at the point in time t6 is higher than the height h5 of the water surface at the point in time t5. That is, the amount of change ΔH (ΔH=h6−h5) between the height h6 of the water surface at the time point t6 and the height h5 of the water surface at the point in time t5 increases. Therefore, by determining whether ΔH is a predetermined value C or more, whether the drain port (68) has an abnormality can be determined.

When it is determined that ΔH is a predetermined value C or more in the Step ST25, the Step ST26 is conducted. In the Step ST26, the communication section (86) outputs an abnormal signal to the communication terminal (90). Accordingly, the communication terminal (90) brings a sign indicating an abnormality to be displayed on the display (92) and brings an alarm to be generated by the alarm unit (93). Therefore, the maintenance provider or the like can quickly know that the drain port (68) has an abnormality.

—Advantages of Second Embodiment—

In the second embodiment, the processing unit (85) determines an abnormality of the predetermined part (drain port (68)) on the basis of the change in a plurality of image data of an object (tray (60)) to be imaged. That is, the processing unit (85) determines the abnormality of the drain port (68) considering not one image data, but the state change in the plurality of image data (two image data in this example). Thus, even if features of the image data are changed by the type of the tray (60) and the installation state of the camera (70), an abnormality of the drain port (68) can be accurately determined on the basis of the change in the plurality of image data.

In the second embodiment, an abnormality of the drain port (68) is determined on the basis of the height h5 of the water surface before, at, or after turning ON of the humidifier (45) and the height h6 of the water surface after a lapse of the predetermined time. Thus, an abnormality of the drain port (68) can be determined using this change.

<Variation of Second Embodiment>

In the second embodiment, an abnormality of the humidifier (45) may be determined on the basis of the wet state of the hygroscopic members (45*a*) in the humidifier (45). In other words, in this variation, objects to be imaged are the hygroscopic members (45*a*), and a predetermined part which is an object for an abnormality determination is the humidifier (45).

Figure 16:
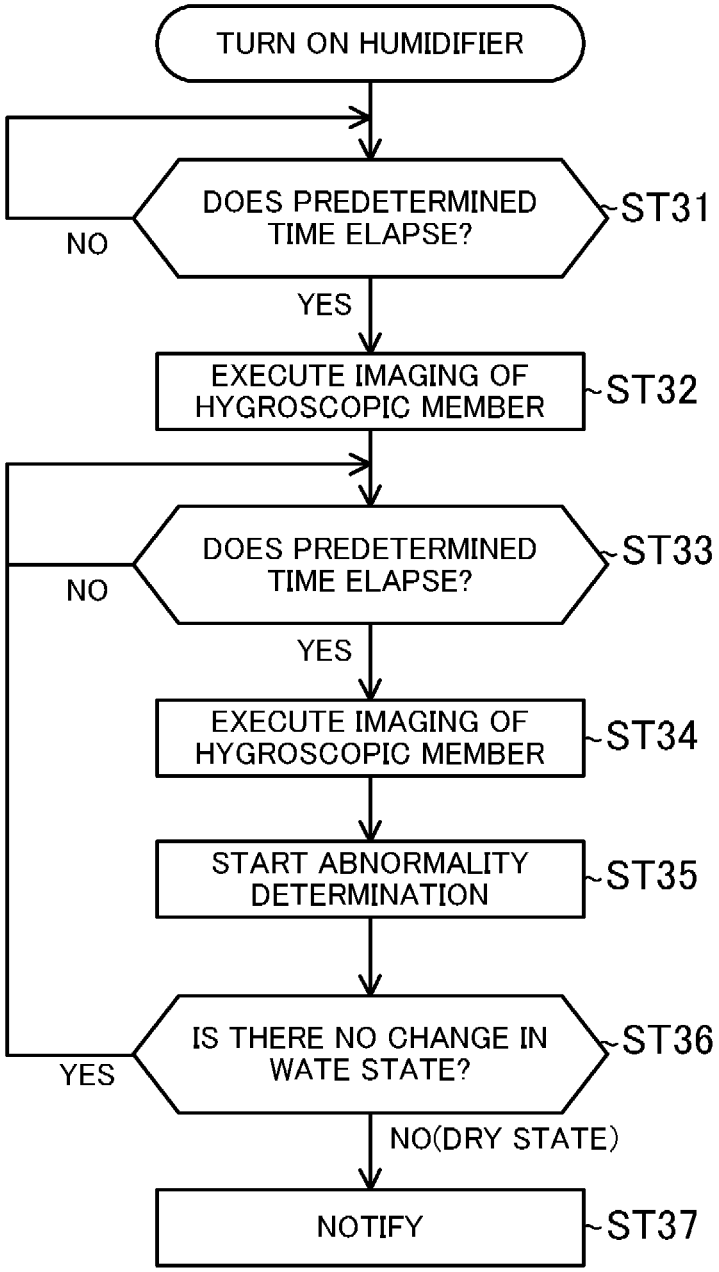
FIG. 16 is a flowchart showing an abnormality determination according to a variation of the second embodiment.

As illustrated in FIG. 16, after the predetermined time T5 elapses from turning ON of the humidifier (45), (Step ST31), the step ST32 is conducted, and imaging of the hygroscopic members (45*a*) is executed at the seventh point in time t7. The predetermined time T5 corresponds to time required for the hygroscopic members (45*a*) to be in the sufficiently wet state by water supplied from a water supply tank.

After predetermined time T6 elapses (Step ST33) thereafter, imaging of the hygroscopic members (45*a*) is executed at the eighth point in time t8. Subsequently, the Step ST35 is conducted to determine an abnormality of the humidifier (45).

When the humidifier (45) functions normally, and a sufficient amount of water is supplied to the hygroscopic members (45*a*), the wet state of the hygroscopic members (45*a*) does not substantially change between the point in time t7 and the point in time t8. On the other hand, when the humidifier (45) has an abnormality, and a sufficient amount of water is not supplied to the hygroscopic members (45*a*), the hygroscopic members (45*a*) at the point in time t8 is further dried compared with the hygroscopic members (45*a*) at the point in time t7. Thus, an abnormality of the humidifier (45) can be determined on the basis of the wet state of such hygroscopic members (45*a*).

When the wet state of the hygroscopic members (45*a*) changes, and the hygroscopic members (45*a*) is in the dried state in the Step ST36, the Step ST36 is conducted. In the Step ST36, the communication section (86) outputs an abnormal signal to the communication terminal (90). Accordingly, the communication terminal (90) brings a sign indicating an abnormality to be displayed on the display (92) and brings an alarm to be generated by the alarm unit (93). Therefore, the maintenance provider or the like can quickly know that the humidifier (45) has an abnormality.

The hygroscopic members (45*a*) of this variation may be formed of a material which changes its color depending on the wet state. In this manner, the change in image data according to the wet state of the hygroscopic members (45*a*) becomes more apparent. This allows the wet state of the hygroscopic members (45*a*) to be determined more accurately.

Further, an abnormality of the humidifier (45) can also be determined on the basis of the change in wet state of the bottom surface of the tray (60) by imaging the inside of the tray (60) by the camera (70).

Other Embodiments

The above-described embodiments (including variations thereof) may have the following configurations.

The processing unit (85) of the above-described embodiments determines the amount of change in height of the water surface in the tray (60) from two image data acquired by the imaging unit (70) and determines an abnormality of the drain pump (66), the drain port (68), and the humidifier (45) on the basis of the amount of change. However, the processing unit (85) may determine the change rate of the height of the water surface in the tray (60) from the change in two image data acquired during a relatively short time period and determine the abnormality on the basis of the change rate. For example, in the first embodiment illustrated in FIGS. 7 and 8, when this change rate (reduction rate of the height of the water surface) is lower than a predetermined value, it is determined that the drain pump (66) has an abnormality. In the variation of the first embodiment illustrated in FIGS. 9 and 10, when this change rate (increase rate of the height of the water surface) is larger than a predetermined value, it is determined that the drain pump (66) has an abnormality. In the variation of the second embodiment illustrated in FIG. 15, when this change rate (reduction rate of the height of the water surface) is larger than a predetermined value, it is determined that the drain port (68) has an abnormality. In this manner, an abnormality of the predetermined parts (45, 66, 68) can be promptly determined using the change rate of the height of the water surface.

The processing unit (85) of the above-described embodiments determines the state(s) of the predetermined part(s) (45, 66, 68) using two image data acquired by the imaging unit (70). The processing unit (85) may determine the state(s) of the predetermined part(s) (45, 66, 68) using three or more image data acquired by the imaging unit (70). The plurality of image data may be image data contained in moving images acquired by the imaging unit (70). That is, the image data includes still images of predetermined frames for constituting moving images.

The processing unit (85) of the above-described embodiments determines an abnormality of the predetermined part (s) (45, 66, 68) using a plurality of image data acquired by the imaging unit (70). The processing unit (85) may determine other states of the predetermined parts (45, 66, 68) on the basis of the plurality of image data. Specifically, the processing unit (85) may determine the state of clogging or a dirt in an air filter, the state of the growth of fungi or a dirt in a tray (60), or the state of the growth of fungi or adhesion of scale on a hygroscopic members (45*a*) of a humidifier (45), on the basis of a plurality of image data.

In the above-described embodiments, when any abnormality of the predetermined parts (45, 66, 68) is determined, an operation of the air-conditioning device (10) may be switched with the determination. For example, in the first embodiment and the variation thereof, when it is determined that the drain pump (66) has an abnormality, the air-conditioning control unit (82) stops the air-conditioning device (10) under the cooling operation or switches to a blowing operation. In the blowing operation, the indoor heat exchanger (43) is substantially stopped, and air is only blown without cooling the air. By such control, the generation of condensed water in the indoor heat exchanger (43) can be reduced, and a further increase in the height of the water surface in the tray (60) can be reduced.

In order to more accurately identify the height of the water surface in the tray (60) from acquired image data in the above-described embodiments, scale or a mark may be attached to the tray (60) or the drain pump (66), or a float member such as a float may be provided inside the tray (60). The camera (70) may be provided in the tray (60) to soak the lens of the camera (70) under the water when the height of the water surface reaches a predetermined value or more. The image data acquired by the soaked camera (70) is completely different in state from the image data acquired by the non-soaked camera (70). Therefore, by comparing these image data, whether the height of the water surface in the tray (60) is a predetermined value or more can be easily determined, in turn, an abnormality of the discharge portion (66, 68) can be determined.

An auxiliary component for detecting the height of the water surface in the tray (60) may further be included. Examples of the auxiliary component include an electrode that detects the height of the water surface on the basis of the energized state in water and an optical sensor that detects the height of the water surface by the degree of reflection on the water surface, provided in the tray (60).

The processing unit (85) may be provided on the camera (70) side or the communication terminal (90) side. The processing unit (85) may be provided in a server on a cloud.

The imaging unit (70) is not limited to a camera and may be, for example, an optical sensor.

The imaging device (70) may be used in a casing of a floor-mounted, wall-mounted, or ceiling-suspended indoor unit, or any other type of indoor unit. The imaging device (70) may be applied to the casing of the outdoor unit.

The air processing device according to the above-described embodiments is an air-conditioning device (10) which controls the state of indoor air. The air processing device may be a humidity control apparatus for controlling the humidity in target space, a ventilation apparatus for ventilating target space, or an air purification apparatus for purifying air in target space.

While the embodiments and variations thereof have been described above, it will be understood that various changes in form and details may be made without departing from the spirit and scope of the claims. The embodiments, the variations thereof, and the other embodiments may be combined and replaced with each other without deteriorating intended functions of the present disclosure. The expressions of "first," "second," "third," described above are used to distinguish the words to which these expressions are given, and the number and order of the words are not limited.

INDUSTRIAL APPLICABILITY

The present disclosure is useful for air processing devices.

DESCRIPTION OF REFERENCE CHARACTERS

10 Air-conditioning Device (Air Processing Device)
20 Casing
45 Humidifier (Predetermined Part)
45 Hygroscopic Member (Object to Be Imaged)
60 Tray (Object to Be Imaged)
66 Drain Pump (Predetermined Part, Discharge Portion)
68 Drain Port (Predetermined Part, Discharge Portion)
70 Camera (Imaging unit)
85 Processing Unit

The invention claimed is:

1. An air processing device comprising:
a casing in which air flows;
a tray for receiving water;
a discharge portion for discharging water in the tray;
an imaging unit that acquires a plurality of image data of at least one predetermined object to be imaged in the casing; and
a processor that determines an abnormality of the discharge portion as at least one predetermined part in the casing on the basis of a change in the plurality of image data acquired by the imaging unit, wherein
the imaging unit acquires a plurality of image data of the tray that is the at least one object to be imaged, and
the processor determines the abnormality of the discharge portion that is the at least one predetermined part on the basis of a change in height of a water surface in the tray in the plurality of image data.

2. The air processing device of claim 1, wherein
the discharge portion include a drain pump for pumping water in the tray.

3. The air processing device of claim 2, wherein
the imaging unit acquires the plurality of image data of the tray during a first time period from a first point in time that is before or at actuation of the drain pump to a second point in time that is after the actuation of the drain pump, and
the processor determines an abnormality of the drain pump on the basis of a change in height of the water surface in the plurality of image data acquired during the first time period.

4. The air processing device of claim 2, wherein
the imaging unit acquires the plurality of image data of the tray during a predetermined second time period after actuation of the drain pump, and
the processor determines an abnormality of the drain pump on the basis of a change in height of the water surface in the plurality of image data acquired during the second time period.

5. The air processing device of claim 1, wherein
the processor determines an abnormality of the discharge portion on the basis of an amount of change in or change rate of the height of the water surface in the plurality of image data.

6. The air processing device of claim 3, wherein the imaging unit acquires the plurality of image data of the tray during a predetermined second time period after actuation of the drain pump, and the processor determines an abnormality of the drain pump on the basis of a change in height of the water surface in the plurality of image data acquired during the second time period.

7. The air processing device of claim 2, wherein the processor determines an abnormality of the discharge portion on the basis of an amount of change in or change rate of the height of the water surface in the plurality of image data.

8. The air processing device of claim 3, wherein the processor determines an abnormality of the discharge portion on the basis of an amount of change in or change rate of the height of the water surface in the plurality of image data.

9. The air processing device of claim 4, wherein the processor determines an abnormality of the discharge portion on the basis of an amount of change in or change rate of the height of the water surface in the plurality of image data.

10. The air processing device of claim 6, wherein the processor determines an abnormality of the discharge portion on the basis of an amount of change in or change rate of the height of the water surface in the plurality of image data.

11. An air processing device comprising:

a casing in which air flows;

a humidifier including at least one hygroscopic member to which water is supplied;

an imaging unit that acquires a plurality of image data of the at least one hygroscopic member as at least one predetermined object to be imaged in the casing; and a processor that determines an abnormality of the humidifier as at least one predetermined part in the casing on the basis of a change in the plurality of image data of the at least one hygroscopic member that is acquired by the imaging unit, wherein the processor determines the abnormality of the humidifier that is the at least one predetermined part on the basis of a change in wet state of the at least one hygroscopic member in the plurality of image data.

12. An imaging system, comprising:

an imaging unit that acquires a plurality of image data of a tray as at least one predetermined object to be imaged in a casing of an air processing device; and a processor that determines an abnormality of a discharge portion for discharging water in the tray in the casing on the basis of a change in the plurality of image data acquired by the imaging unit, wherein the processor determines the abnormality of the discharge portion on the basis of a change in height of a water surface in the tray in the plurality of image data.

13. An imaging system, comprising:

an imaging unit that acquires a plurality of image data of at least one hygroscopic member of a humidifier as at least one predetermined object to be imaged in a casing of an air processing device; and a processor that determines an abnormality of the humidifier on the basis of a change in the plurality of image data of the at least one hygroscopic member that is acquired by the imaging unit, wherein the processor determines the abnormality of the humidifier on the basis of a change in wet state of the at least one hygroscopic member in the plurality of image data.

* * * * *